United States Patent [19]

Weber

[11] Patent Number: 4,988,024

[45] Date of Patent: Jan. 29, 1991

[54] METAL COLLECTION VESSEL

[76] Inventor: Robert D. Weber, 554 Huth Rd., Cheektowaga, N.Y. 14225

[21] Appl. No.: 500,898

[22] Filed: Mar. 29, 1990

[51] Int. Cl.[5] ..... A45F 5/00

[52] U.S. Cl. ..... 224/226; 224/253; 224/270; 224/907

[58] Field of Search ..... 224/201, 202, 204, 206, 224/208–212, 215, 216, 224–226, 252, 253, 259–263, 265, 270, 904, 907

[56] References Cited

U.S. PATENT DOCUMENTS

| | | | |
|---|---|---|---|
| 861,850 | 7/1907 | Hill | 224/204 |
| 898,315 | 9/1908 | Carpenter | 224/209 |
| 1,530,342 | 3/1925 | Barber | 224/224 |
| 1,736,131 | 11/1929 | Reece et al. | 224/202 |
| 2,679,960 | 6/1954 | Lowe | 224/202 |
| 2,985,349 | 5/1961 | McGuire | 224/907 X |
| 3,115,638 | 12/1963 | Kikas | 224/208 X |
| 4,515,300 | 5/1975 | Cohen | 224/253 X |
| 4,898,311 | 2/1990 | Boyer | 224/208 X |
| 4,915,278 | 4/1990 | Smith | 224/202 X |

FOREIGN PATENT DOCUMENTS

| | | | |
|---|---|---|---|
| 0038548 | 12/1923 | Norway | 224/270 |
| 0650268 | 2/1951 | United Kingdom | 224/208 |

*Primary Examiner*—Henry J. Recla
*Assistant Examiner*—Casey Jacyna
*Attorney, Agent, or Firm*—James J. Ralabate

[57] ABSTRACT

This invention provides a novel collection wire basket that has a bottom mesh structure. This permits sand and other debris to fall from the basket retaining an item that is larger than the openings in the wire basket. The basket also contains a bottom deflector plate which deflects sand or other materials away from the user's body. The side of the basket abutting the user's body is a solid panel to prevent contact of the contents of the container with the user's body.

6 Claims, 3 Drawing Sheets

Fig. 1
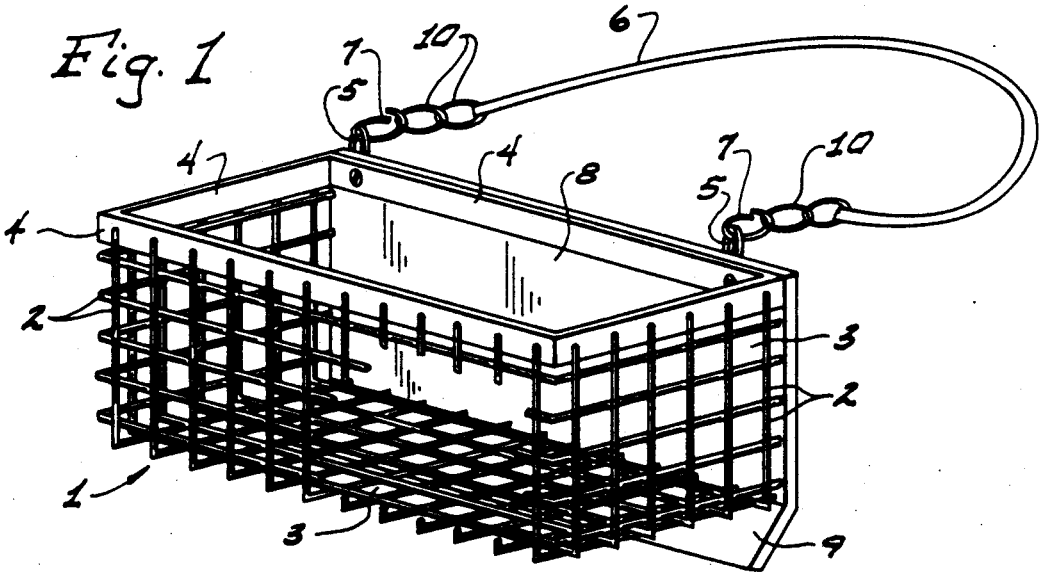
Fig. 2
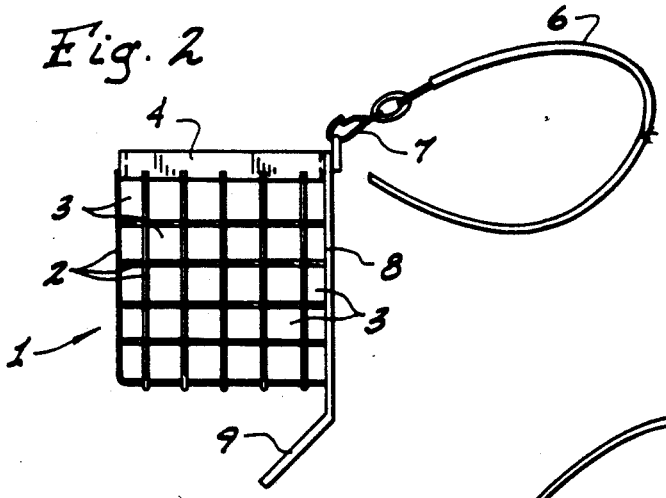
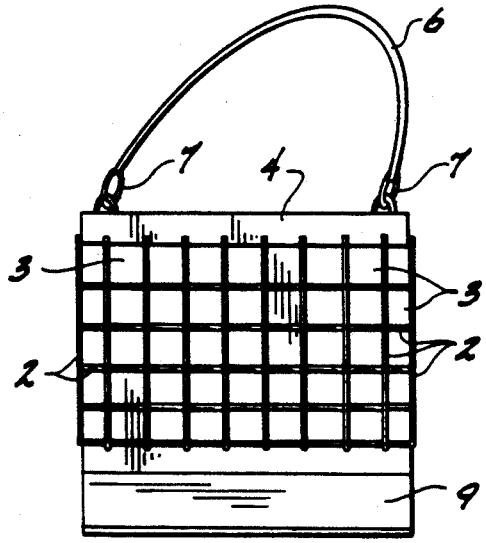
Fig. 3

METAL COLLECTION VESSEL

This application relates to a container and, more specifically, for a container that can be worn on the body of a user during treasure hunts and the like.

BACKGROUND OF THE INVENTION

There are conducted at various locations treasure or relic hunts wherein metal detectors are used to detect objects buried in the ground, sand and soil. Many of these hunts are conducted along a beach or other shore line. Several of these type hunts are discussed in the book *Treasure Recovery from Sand and Sea*, first edition, Jan. 1988, Library of Congress Catalog Card No. 87-063128 by Charles L. Garrett. This book describes techniques, equipment and ideas in this activity. There are also several other publications dealing with treasure and relic hunting such as the periodical "Lost Treasure" published by Lost Treasure, Inc., PO Box 1589, Grove, Okla. 74344. "Western and Eastern Treasures", Vol. 24, Feb., 1990, published by Peoples Publishing Co., Inc., PO Box 1095, Arcate, Calif. 95521 discloses specifics of treasure hunting including equipment and locations recommended. In all of these publications hunt sites, hunt contests and all other relevant information on use of present equipment are discussed.

Metal detectors and accessories are the main pieces of equipment required in these type activities. There are metal detectors of all kinds including those for use over sand and below water. Various clubs have been formed to assist hunters on locations and equipment, in addition to sponsoring contests where cash and other prizes are awarded to winners. Thus, treasure hunting has become not only an exciting activity but also can be profitable to those who can increase their skill at it.

One of the concerns in collecting buried articles has been to find and retrieve these treasures or items before someone else. In contests, for example, it is not uncommon for hundreds of people to be searching in the same general area for buried articles. While metal detectors and their effectiveness are extremely important to this activity, collection vessels for retrieval have become equally important. Once an article is detected by a metal detector, the hunter stops to scoop it out of the sand, clean if off and deposit it in some type of secure container as he continues on his search or hunt. Hunters have used all types of collection vessels such as bags, boxes and nets, but none of these provide adequate means especially during competitive hunts. In several beachcombing expeditions or hunts it is necessary to stop to clean sand from the retrieval object before proceeding with the hunt.

SUMMARY OF THE INVENTION

It is therefore an object of this invention to provide a novel container for use in treasure hunts and the like.

It is another object of this invention to provide a novel collection vessel that will allow sand or other debris to filter out of the container while retaining the retrieved item.

Another object of this invention is to provide a novel container with a crush guard to provide stability and that is equally usable by both left and right handed individuals.

Still a further object of this invention is to provide a novel container where sand or other debris is directed out of the container away from the body of the user.

Yet another object of this invention is to provide for a comfortable container that can be easily worn and removed.

Still yet a further object of this invention is to provide a novel container that permits near optimum retrieval speed in hunting contests and the like.

These and other objects of this invention are provided by a novel container comprising a basket-like configuration having an open grid lattice or structure. These openings should be sufficient to retain the retrieved item while permitting the sand to fall out of the container. Usually a ½ inch square mesh structure is desirable; however, any suitable lattice opening may be used. The basket has a waist or shoulder attachment means preferably in the form of a plastic tube to prevent digging into the body of the user. However, any suitable attachment means may be used such as belts, chains, ropes and the like. On either end of the waist tube is a plurality of chain links to make the tube flexible in use and also to provide additional strength and security to the body attachment. A brace or retention means encircles the top portion of the basket to ensure the integrity of the basket and to prevent deformation or collapsing of the basket structure. The side of the basket that fits against the body of the user is a solid panel to keep sand and other debris away from the user's body. Extending downward from this solid panel is a sand deflector that allows the sand to fall out of the container and is directed away from the user's body. It is critical to this invention that there be a solid body panel and a sand deflector to protect the user's body from sand and other unwanted material that is dug up with the item. Items such as buried prizes, treasures, coins, relics and the like often are encrusted with sand or soil when buried. The container of this invention is uniquely suited to collect these items while retaining a small amount, if any, of the surrounding debris. The debris collected such as bottle caps, cans, nails, etc. are accumulated and disposed of in proper containers for proper disposal. Natural debris such as sand, pebbles, etc. is returned to the beach. While it is preferred that the container be constructed of aluminum or other lightweight and strong material, any suitable material may be used. For example, other lightweight non-corrosive metals may be used, lightweight plastics or other synthetic materials or any other suitable materials. It is important that whatever material used for the construction be lightweight, non-corrosive, substantially strong and have the proper grid or lattice structure.

BRIEF DESCRIPTION OF THE DRAWINGS

FIG. 1 is a perspective view of the container of this invention.

FIG. 2 is a side plan view of the container of this invention.

FIG. 3 is a front plan view of the container of this invention.

DESCRIPTION OF THE DRAWING AND PREFERRED EMBODIMENT

Figure 4:
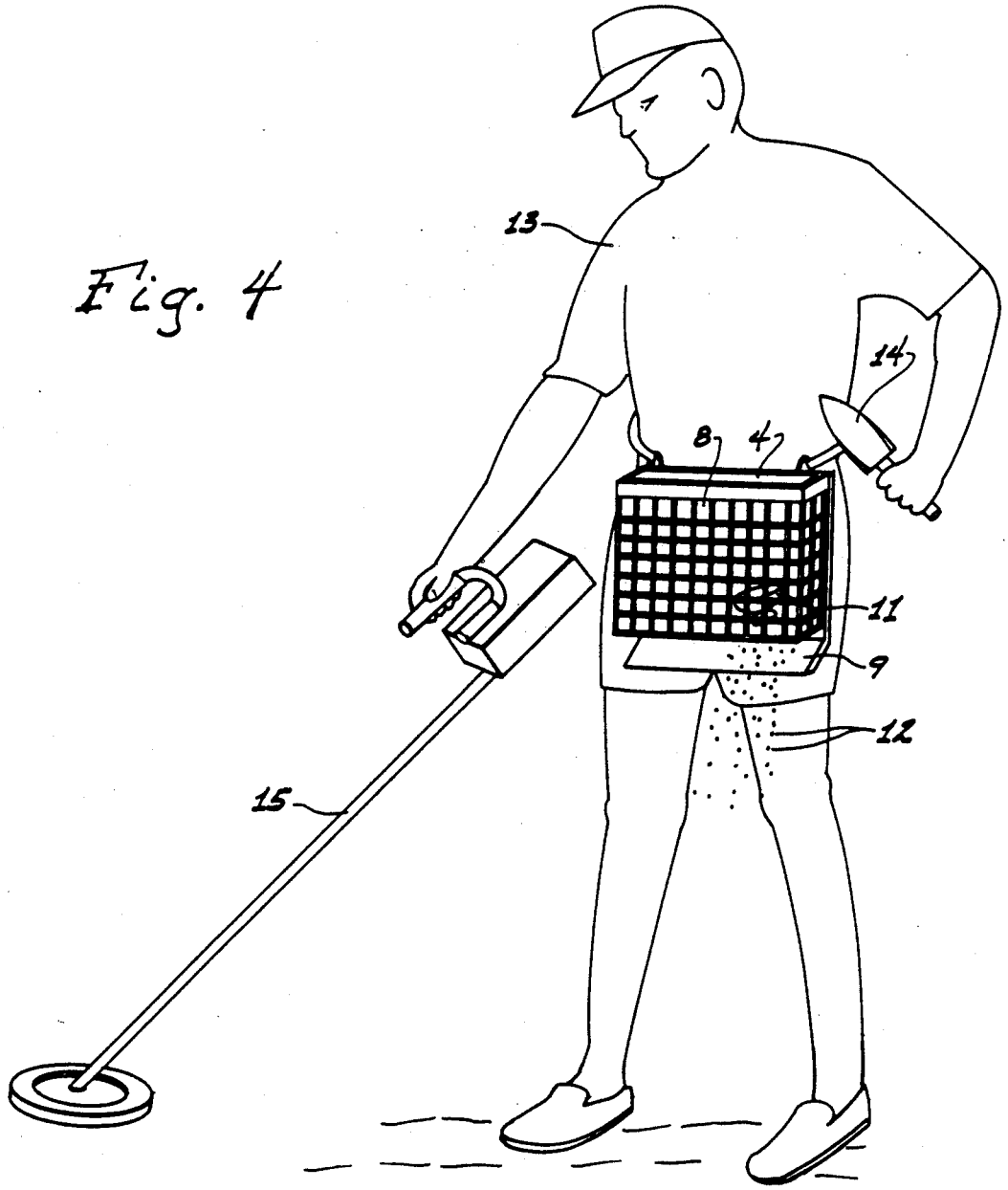
FIG. 4 is a perspective view of the container of this invention as worn with sand falling away from the user's body.

In FIG. 1, the vessel or container comprises a substantially rectangular (any configuration such as round could be used), mesh basket having a grid or network of wires 2 which cross to define openings 3 therebetween. The spaces or openings 3 should be ideally about ⅛ to ¾ inches in diameter; however, any suitable size opening 3 can be used. Around the top portion of the basket 1 is a retaining support or crush guard 4 which maintains the rectangular (or other) configuration of the container during use and storage. This guard 4 can be a metal bar which encircles the upper peripheral opening of basket 1. On the two upper inside corners of basket 1 are belt attachment means 5 which permit retaining means belt or tube 6 to be connected to either or both ends of the basket 1. By upper inside corner is meant the two corners of the mesh basket closest to the user's body. It is desirable to place two or three chain links 10 at at least one end of tube 6 so that tube 6 is flexible and comfortable when worn (see figure 1A). Also an attachment clip 7 can be located at both ends of tube 6 so that it is equally convenient for a right or left handed user. At the rear side portion of basket 1, which abuts the user's body, is a solid panel 8 that protects the user's body against contact with contents of basket 1. Extending downward from panel 8 is a solid sand deflector 9 that directs sand or other debris away from the user's body. A chain or other strengthening means can be threaded through tube 6 to give it additional strength. FIG. 1A shows a close up of attachment means with tube 6 attached to the corners of basket 1.

In FIG. 2 a side plan view of the container of this invention is illustrated. A box-like basket 1 comprises a series of grid wires 2 which make up at least the bottom portion and preferably three sides of the basket 1, the only side not having a grid of wires 2 is the basket side adjacent the user's body. This adjacent side is made up of a solid panel 8 which keeps the contents of basket 1 away from the user's body. Surrounding the upper open end of the basket 1 is a crush guard 4 which is made from a structurally strong material such as aluminum. This crush guard 4 keeps the basket 1 structurally sound and ensures that the basket opening maintains its configuration. Extending downward from panel 8 is a sand deflector 9 that is angled away from the body at any suitable acute angle. Generally, an angle of from about 30 degrees to 60 degrees is preferred that is angled from the bottom of basket 1. The intersections of wires 2 form openings 3 which are large enough to permit the sand or soil to fall free out of basket 1 and openings 3 are small enough to retain the item retrieved. Attached to the inner upper corners of basket 1 is a retaining tube or strap 6 which fits around the wearer's waist. This tube 6 can be adjustable if desired, but should have attachment clips or catch 7 on both ends of tube 6 to accommodate use by either right or left handed users.

In FIG. 3 the container is shown in a front view as described in FIGS. 1 and 2 with a wire 2 mesh, openings 3, tube waist band 6, tube connection clips 7, crush guard 4 and deflector panel 9. Both crush guard 4 and solid back panel 8 maintain the configuration of basket 1 and supply the structural support needed in use and storage.

In FIG. 4 an item 11 retrieved is put into basket 1 with the sand 12 falling through the bottom lattice work of basket 1 and directed away from the user's body by deflector panel 9. This permits the user 13 to expeditiously retrieve item 11 without having to stop to brush off sand 12 which may be dug up by shovel scoop 14 when retrieving or digging out an item from the beach. Once metal detector 15 signals the location of an item 11 the user scoops out the item 11, puts it into basket 1 and rapidly moves on to the next item to be retrieved.

Figure 5:
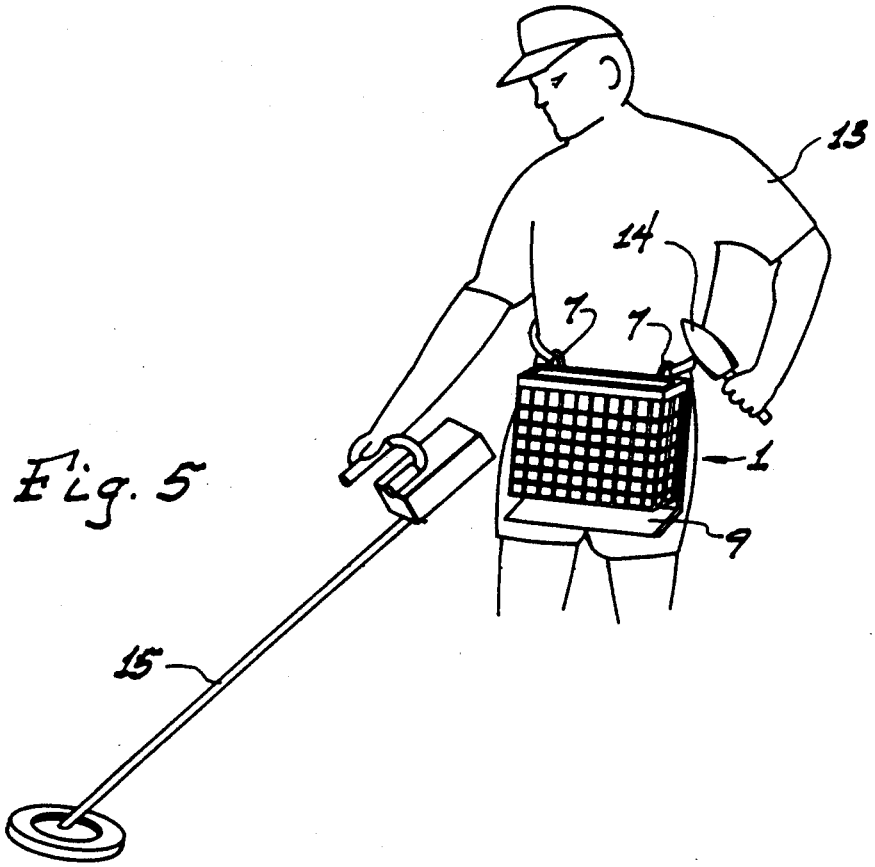
FIG. 5 is a perspective view of the container of this invention as it is worn around the shoulder of a user.

In FIG. 5 the basket 1 is shown as worn around the waist of a user leaving both hands free to direct the metal detector 15 and hold shovel 14 when searching for buried items. The angling out of deflector 9 away from the user's body can be clearly seen in FIG. 5.

Figure 6:
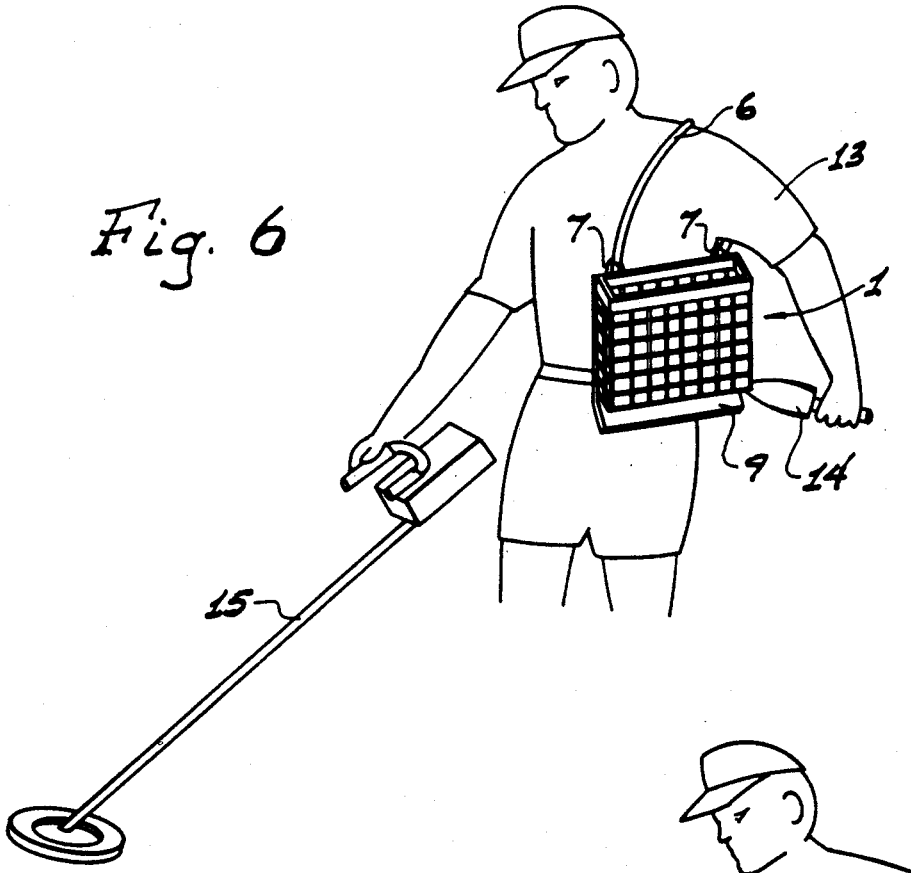
FIG. 6 is a perspective view of the preferred embodiment of the container of this invention as it is worn around the waist of the user.

FIG. 6 illustrates basket 1 when worn over the shoulder. In this embodiment adjustable chain or tube 6 is merely extended to accommodate the increase in length needed to fit over a shoulder. The embodiment of FIG. 5 is preferred for ease and comfort of use.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A collection vessel having a rectangular configuration comprising in combination a mesh basket, a solid back panel, a deflection panel and retaining means, said mesh basket comprising a plurality of wires that intersect to form a plurality of openings, said mesh basket having a mesh structure on at least one side and its bottom portion to permit sand or other materials to fall therethrough, said mesh basket comprising a substantially solid back panel on a side to be worn against the user's body, and extending downwardly from and beyond a bottom portion of said basket is a substantially planar deflector panel which is angled away from said user's body to deflect materials falling through said bottom portion away from the user's body, said mesh basket having around substantially a mesh portion of its upper peripheral portion a crush guard which maintains and strengthens the rectangular configuration of said vessel.

2. The collection vessel of claim 1 wherein said retaining means comprises means to attach said collection vessel to a user's body.

3. The collection vessel of claim 1 wherein said retaining means comprises a tubular means adapted to encircle the waist of a user.

4. The collection vessel of claim 1 wherein said basket has a mesh structure on all sides except for the basket side abutting a user's body.

5. The collection vessel of claim 1 wherein said retaining means comprises basket attachment means that are removably positioned on both upper corners of said basket to accomodate both left and right hand users.

* * * * *